US008727716B2

(12) United States Patent
Clements et al.

(10) Patent No.: US 8,727,716 B2
(45) Date of Patent: May 20, 2014

(54) TURBINE NOZZLE WITH CONTOURED BAND

(75) Inventors: Jeffrey Donald Clements, Mason, OH (US); Vidhu Skekhar Pandey, West Chester, OH (US); Ching-Pang Lee, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 756 days.

(21) Appl. No.: 12/872,485

(22) Filed: Aug. 31, 2010

(65) Prior Publication Data

US 2012/0051900 A1 Mar. 1, 2012

(51) Int. Cl.
*F01D 9/04* (2006.01)

(52) U.S. Cl.
USPC ..... 415/191

(58) Field of Classification Search
USPC ..... 415/191, 199.5, 211.2
See application file for complete search history.

(56) References Cited

U.S. PATENT DOCUMENTS

| | | | | |
|---|---|---|---|---|
| 6,017,186 | A * | 1/2000 | Hoeger et al. | 415/181 |
| 6,283,713 | B1 * | 9/2001 | Harvey et al. | 416/193 A |
| 6,561,761 | B1 * | 5/2003 | Decker et al. | 415/173.1 |
| 6,609,880 | B2 * | 8/2003 | Powis et al. | 415/1 |
| 6,669,445 | B2 * | 12/2003 | Staubach et al. | 416/193 A |
| 7,134,842 | B2 * | 11/2006 | Tam et al. | 416/193 A |
| 7,220,100 | B2 * | 5/2007 | Lee et al. | 415/191 |
| 7,354,243 | B2 * | 4/2008 | Harvey | 415/191 |
| 7,465,155 | B2 * | 12/2008 | Nguyen | 416/193 R |
| 7,690,890 | B2 * | 4/2010 | Aotsuka et al. | 415/191 |
| 8,366,399 | B2 * | 2/2013 | Allen-Bradley et al. | 416/228 |
| 8,439,643 | B2 * | 5/2013 | Kuhne et al. | 416/193 A |
| 8,459,956 | B2 * | 6/2013 | Pandey et al. | 416/243 |
| 8,647,067 | B2 * | 2/2014 | Pandey et al. | 416/223 R |
| 2006/0233641 | A1 * | 10/2006 | Lee et al. | 415/208.1 |
| 2007/0059177 | A1 * | 3/2007 | Harvey | 416/179 |
| 2007/0258810 | A1 * | 11/2007 | Aotsuka et al. | 415/206 |
| 2010/0143139 | A1 * | 6/2010 | Pandey et al. | 416/179 |
| 2011/0110788 | A1 * | 5/2011 | Guimbard et al. | 416/241 R |
| 2011/0189023 | A1 * | 8/2011 | Guimbard et al. | 416/223 R |
| 2012/0051894 | A1 * | 3/2012 | Clements et al. | 415/191 |
| 2012/0051900 | A1 * | 3/2012 | Clements et al. | 415/208.2 |
| 2013/0017080 | A1 * | 1/2013 | Tham et al. | 415/208.1 |
| 2013/0017095 | A1 * | 1/2013 | Lee et al. | 416/239 |
| 2013/0224027 | A1 * | 8/2013 | Barr et al. | 416/193 A |
| 2013/0251520 | A1 * | 9/2013 | Barr et al. | 415/208.2 |

* cited by examiner

*Primary Examiner* — Edward Look
*Assistant Examiner* — Christopher R Legendre
(74) *Attorney, Agent, or Firm* — William Scott Andes; Trego, Hines & Ladenheim, PLLC

(57) ABSTRACT

A turbine nozzle includes an array of turbine vanes between inner and outer bands. Each vane includes opposed pressure and suction sides extending between opposed leading and trailing edges. The vanes define a plurality of flow passages each of which is bounded between the inner band, the outer band, and adjacent first and second vanes. A surface of the inner band in each of the passages is contoured in a non-axisymmetric shape including a peak of relatively higher radial height adjoining the pressure side of the first vane adjacent its leading edge, and a trough of relatively lower radial height is disposed parallel to and spaced-away from the suction side of the second vane aft of its leading edge. The peak and trough define cooperatively define an arcuate channel extending axially along the inner band between the first and second vanes.

5 Claims, 7 Drawing Sheets

TURBINE NOZZLE WITH CONTOURED BAND

STATEMENT REGARDING FEDERALLY SPONSORED RESEARCH AND DEVELOPMENT

The U.S. Government may have certain rights in this invention pursuant to contract number W911W6-07-2-0002 awarded by the Department of the Army.

BACKGROUND OF THE INVENTION

The present invention relates generally to gas turbine engines, and more specifically, to turbines therein.

In a gas turbine engine, air is pressurized in a compressor and subsequently mixed with fuel and burned in a combustor to generate combustion gases. One or more turbines downstream of the combustor extract energy from the combustion gases to drive the compressor, as well as a fan, shaft, propeller, or other mechanical load. Each turbine comprises one or more rotors each comprising a disk carrying an array of turbine blades or buckets. A stationary nozzle comprising an array of stator vanes having radially outer and inner endwalls in the form of annular bands is disposed upstream of each rotor, and serves to optimally direct the flow of combustion gases into the rotor. Collectively each nozzle and the downstream rotor is referred to as a "stage" of the turbine.

The complex three-dimensional (3D) configuration of the vane and blade airfoils is tailored for maximizing efficiency of operation, and varies radially in span along the airfoils as well as axially along the chords of the airfoils between the leading and trailing edges. Accordingly, the velocity and pressure distributions of the combustion gases over the airfoil surfaces as well as within the corresponding flow passages also vary.

Undesirable pressure losses in the combustion gas flowpaths therefore correspond with undesirable reduction in overall turbine efficiency. For example, the combustion gases enter the corresponding rows of vanes and blades in the flow passages therebetween and are necessarily split at the respective leading edges of the airfoils.

The locus of stagnation points of the incident combustion gases extends along the leading edge of each airfoil. Corresponding boundary layers are formed along the pressure and suction sides of each airfoil, as well as along each radially outer and inner endwall which collectively bound the four sides of each flow passage. In the boundary layers, the local velocity of the combustion gases varies from zero along the endwalls and airfoil surfaces to the unrestrained velocity in the combustion gases where the boundary layers terminate.

One common source of turbine pressure losses is the formation of horseshoe and passage vortices generated as the combustion gases are split in their travel around the airfoil leading edges. A total pressure gradient is effected in the boundary layer flow at the junction of the leading edge and endwalls of the airfoil. This pressure gradient at the airfoil leading edges forms a pair of counterrotating horseshoe vortices which travel downstream on the opposite sides of each airfoil near the endwall. Turning of the horseshoe vortices introduces streamwise vorticity and thus builds up a passage vortex as well.

The two vortices travel aft along the opposite pressure and suction sides of each airfoil and behave differently due to the different pressure and velocity distributions therealong. For example, computational analysis indicates that the suction side vortex migrates away from the endwall toward the airfoil trailing edge and then interacts following the airfoil trailing edge with the pressure side vortex flowing aft thereto.

The interaction of the pressure and suction side vortices occurs near the mid-span region of the airfoils and creates total pressure loss and a corresponding reduction in turbine efficiency. These vortices also create turbulence and increase undesirable heating of the endwalls.

Since the horseshoe and passage vortices are formed at the junctions of turbine rotor blades and their integral root platforms, as well at the junctions of nozzle stator vanes and their outer and inner bands, corresponding losses in turbine efficiency are created, as well as additional heating of the corresponding endwall components.

Accordingly, it is desirable to minimize horseshoe and passage vortex effects.

BRIEF SUMMARY OF THE INVENTION

The above-mentioned need is met by the present invention, which provides a turbine nozzle having a 3D-countoured inner band surface.

According to one aspect of the invention, a turbine nozzle includes an array of turbine vanes between inner and outer bands. Each vane includes opposed pressure and suction sides extending between opposed leading and trailing edges. The vanes define a plurality of flow passages each of which is bounded between the inner band, the outer band, and adjacent first and second vanes. A surface of the inner band in each of the passages is contoured in a non-axisymmetric shape including a peak of relatively higher radial height adjoining the pressure side of the first vane adjacent its leading edge, and a trough of relatively lower radial height is disposed parallel to and spaced-away from the suction side of the second vane aft of its leading edge. The peak and trough define cooperatively define an arcuate channel extending axially along the inner band between the first and second vanes.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
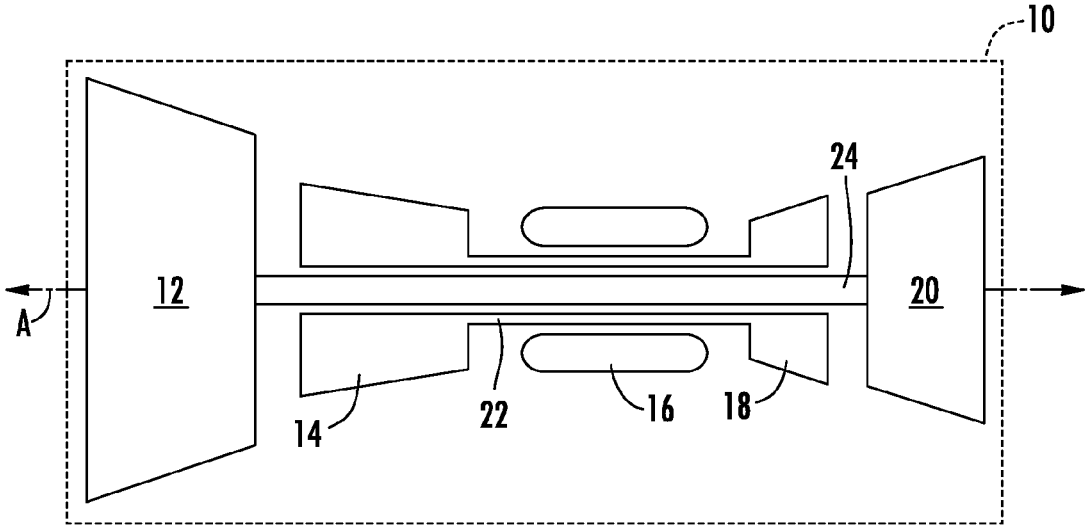
FIG. 1 is a schematic view of a gas turbine engine incorporating a turbine nozzle constructed according to an aspect of the present invention.

Referring to the drawings wherein identical reference numerals denote the same elements throughout the various views, FIG. 1 depicts schematically the elements of an exemplary gas turbine engine 10 having a fan 12, a high pressure compressor 14, a combustor 16, a high pressure turbine ("HPT") 18, and a low pressure turbine 20, all arranged in a serial, axial flow relationship along a central longitudinal axis "A". Collectively the high pressure compressor 14, the combustor 16, and the high pressure turbine 18 are referred to as a "core". The high pressure compressor 14 provides compressed air that passes into the combustor 12 where fuel is introduced and burned, generating hot combustion gases. The hot combustion gases are discharged to the high pressure turbine 18 where they are expanded to extract energy therefrom. The high pressure turbine 18 drives the compressor 10 through an outer shaft 22. Pressurized air exiting from the high pressure turbine 18 is discharged to the low pressure turbine ("LPT") 20 where it is further expanded to extract energy. The low pressure turbine 20 drives the fan 12 through an inner shaft 24. The fan 12 generates a flow of pressurized air, a portion of which supercharges the inlet of the high pressure compressor 14, and the majority of which bypasses the "core" to provide the majority of the thrust developed by the engine 10.

While the illustrated engine 10 is a high-bypass turbofan engine, the principles described herein are equally applicable to turboprop, turbojet, and turboshaft engines, as well as turbine engines used for other vehicles or in stationary applications. Furthermore, while a LPT nozzle is used as an example, it will be understood that the principles of the present invention may be applied to any turbine blade having inner and outer shrouds or platforms, including without limitation HPT and intermediate-pressure turbine ("IPT") vanes. Furthermore, the principles described herein are also applicable to turbines using working fluids other than air, such as steam turbines.

Figure 2:
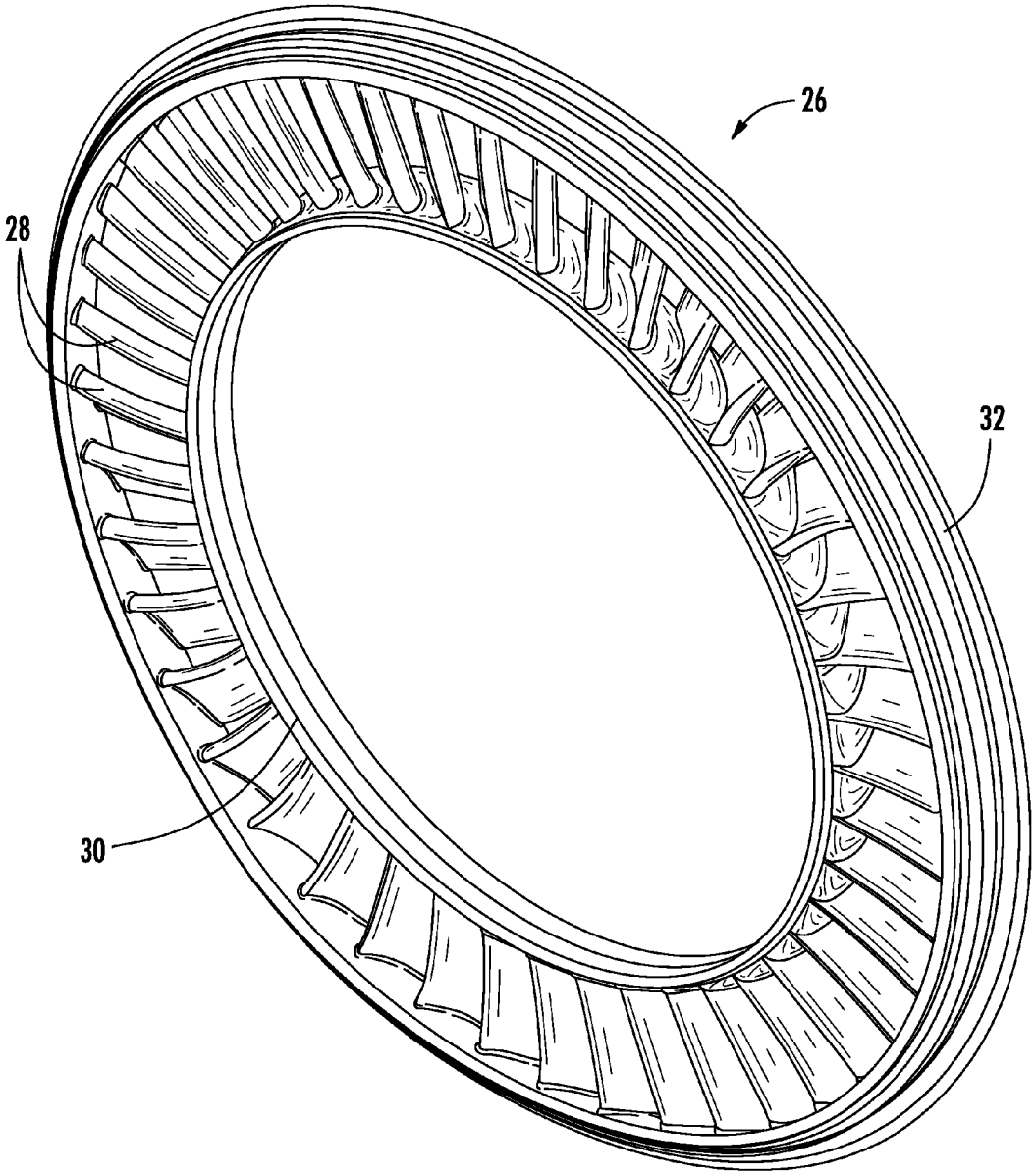
FIG. 2 is a perspective view of a turbine nozzle of the engine shown in FIG. 1.
Figure 3:
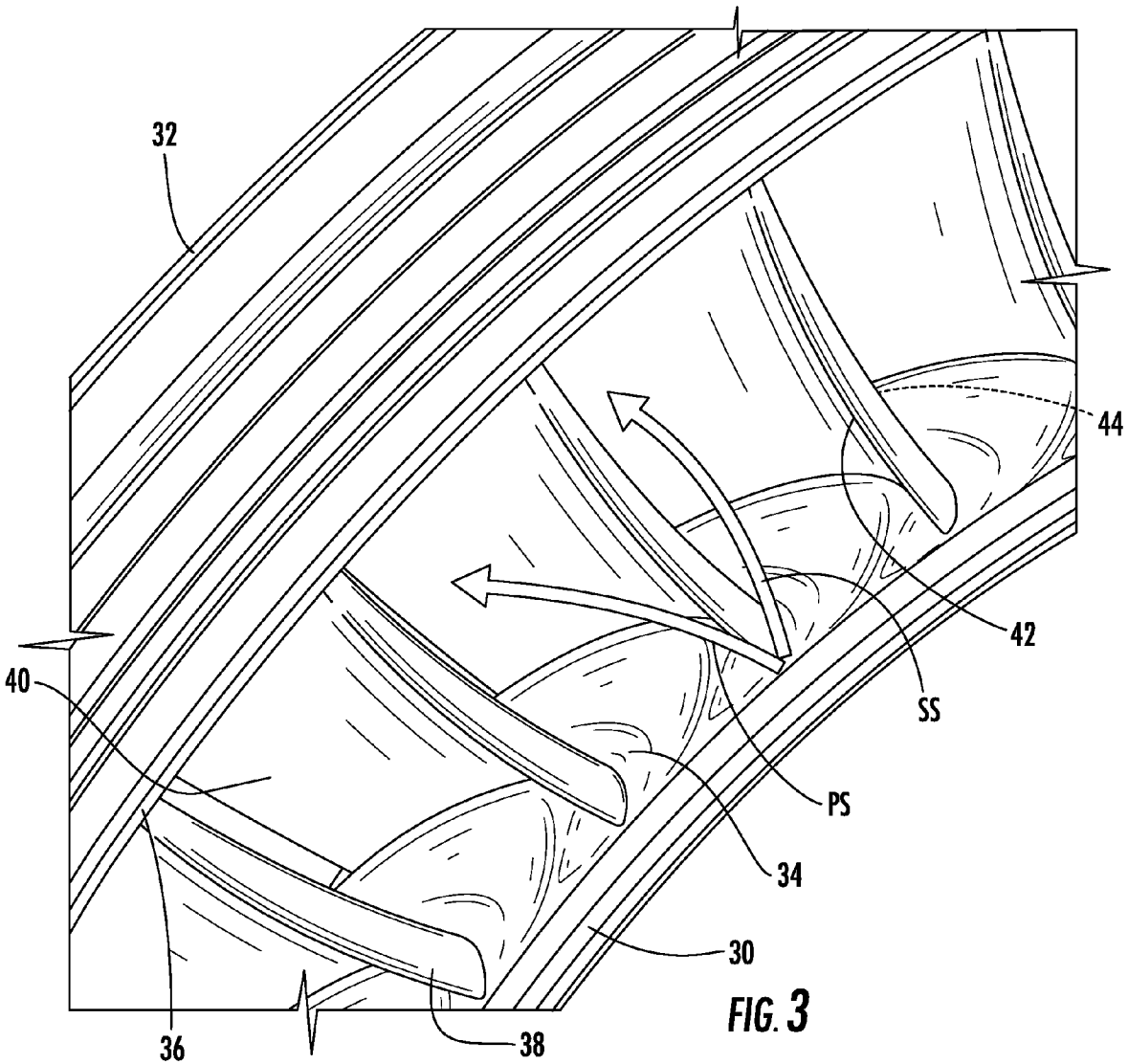
FIG. 3 is a perspective view of a portion of the turbine nozzle shown in FIG. 2.

The LPT 20 includes a series of stages each having a stationary nozzle and a downstream rotating disk with turbine blades or buckets (not shown). FIGS. 2 and 3 illustrate one of the turbine nozzles 26. It may be of unitary or built-up construction and includes a plurality of turbine vanes 28 disposed between an annular inner band 30 and an annular outer band 32. Each vane 28 is an airfoil including a root 34, a tip 36, a leading edge 38, trailing edge 40, and a concave pressure side 42 opposed to a convex suction side 44. The inner and outer bands 30 and 32 define the inner and outer radial boundaries, respectively, of the gas flow through the turbine nozzle 26. The inner band 30 has a "hot side" 31 facing the hot gas flowpath and a "cold side" facing away from the hot gas flowpath, and includes conventional mounting structure. Similarly, the outer band 32 has a cold side and a hot side and includes conventional mounting structure.

In operation, the gas pressure gradient at the airfoil leading edges causes the formation of a pair of counterrotating horseshoe vortices which travel downstream on the opposite sides of each airfoil near the inner band 30. FIG. 3 illustrates schematically the direction of travel of these vortices, where the pressure side and suction side vortices are labeled PS and SS, respectively.

As shown in FIGS. 4-10, the hot side 31 of the inner band 30, specifically the portion of the inner band between each vane 28, is preferentially contoured in elevation relative to a conventional axisymmetric or circular circumferential profile in order to reduce the adverse effects of the vortices generated as the combustion gases split around the leading edges 38 of the vanes 28 as they flow downstream over the inner band 30 during operation. In particular the inner band contour is non-axisymmetric, but is instead contoured in radial elevation from a wide peak 46 adjacent the pressure side 42 of each vane 28 to a depressed narrow trough 48. This contouring is referred to generally as "3D-contouring".

Figure 4:
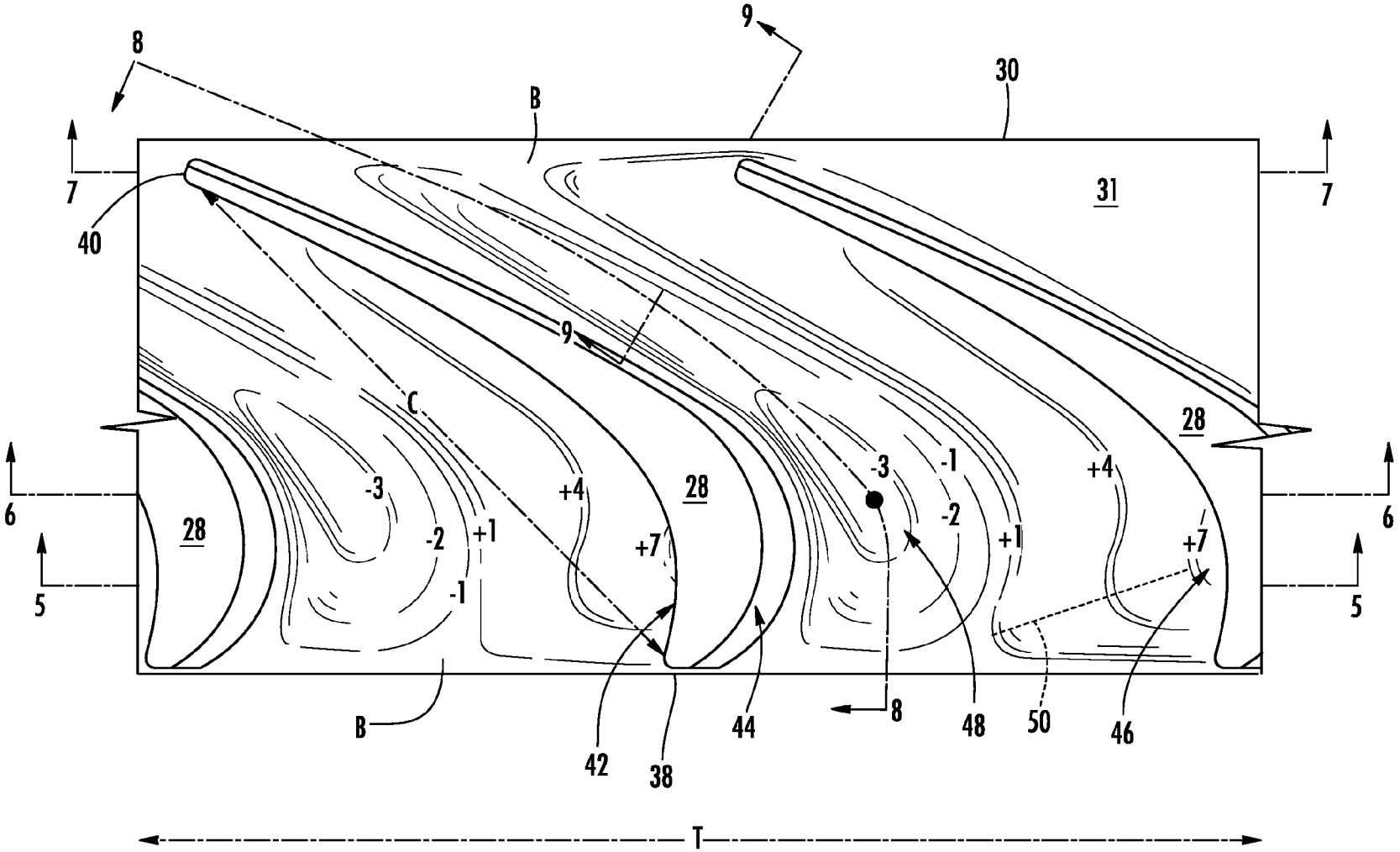
FIG. 4 is a cross-sectional view of a portion of the turbine nozzle shown in FIG. 2.

The 3D-contouring is explained with reference to FIGS. 4-10. A typical prior art inner band generally has a surface profile which is convexly-curved in a shape similar to the top surface of an airfoil when viewed in longitudinal cross-section (see FIG. 8). This profile is a symmetrical surface of revolution about the longitudinal axis A of the engine 10. This profile is considered a baseline reference, and in each of FIGS. 5-9, a baseline prior art surface profile is illustrated with a dashed line denoted "B" and the 3D-contoured surface profile is shown with an solid line. Points having the same height or radial dimension are interconnected by contour lines in the Figures. As seen in FIG. 4, each of the vanes 28 has a chord length "C" measured from its leading edge 38 to its trailing edge 40, and a direction parallel to this dimension denotes a "chordwise" direction. A direction parallel to the forward or aft edges of the inner band 30 is referred to as a tangential direction as illustrated by the arrow marked "T" in FIG. 4. As used herein, it will be understood that the terms "positive elevation", "peak" and similar terms refer to surface characteristics located radially outboard or having a greater radius measured from the longitudinal axis A than the local baseline B, and the terms "trough", "negative elevation", and similar terms refer to surface characteristics located radially inboard or having a smaller radius measured from the longitudinal axis A than the local baseline B.

Figure 8:
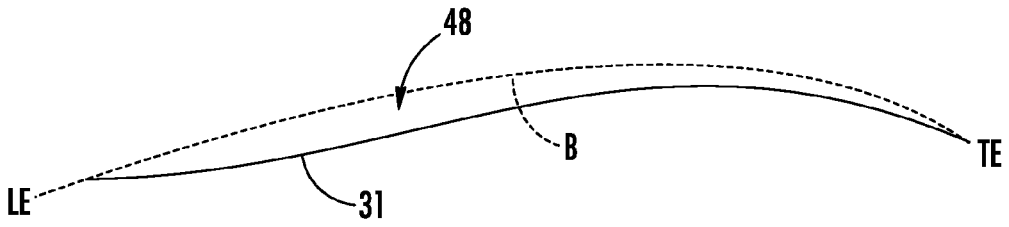
FIG. 8 is a view taken along lines 8-8 of FIG. 4.
Figure 9:
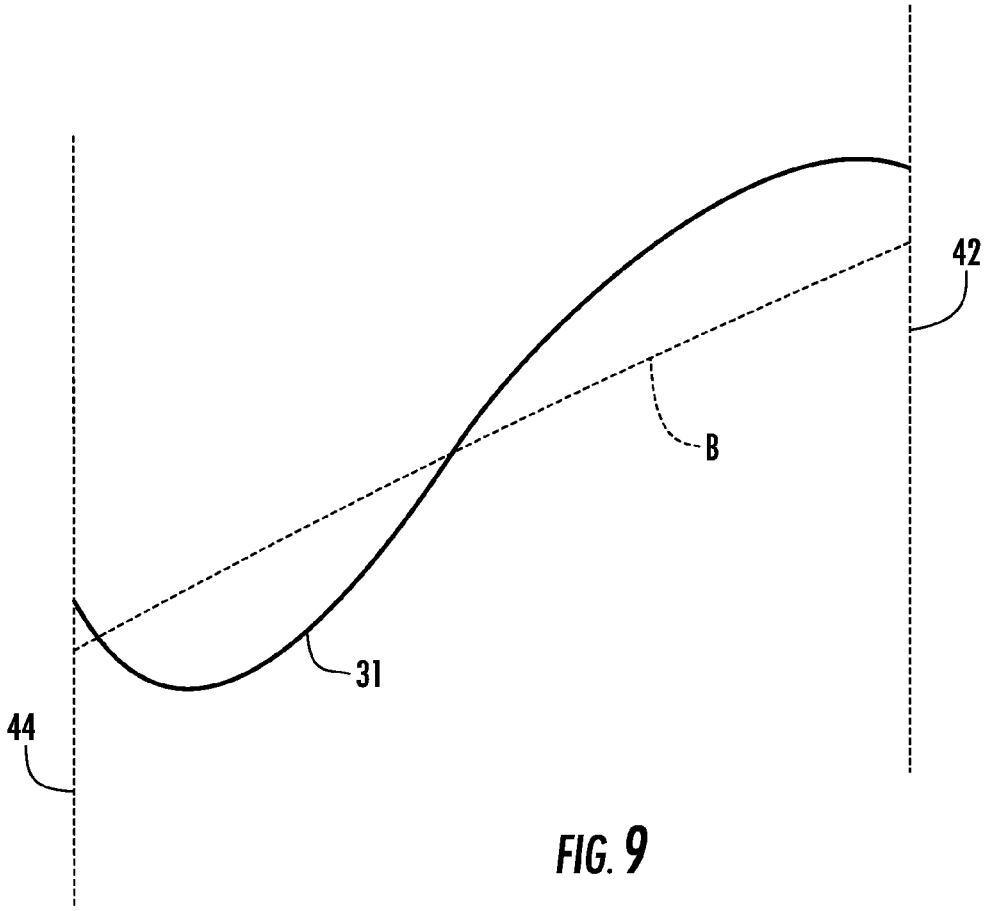
FIG. 9 is a view taken along lines 9-9 of FIG. 4.
Figure 10:
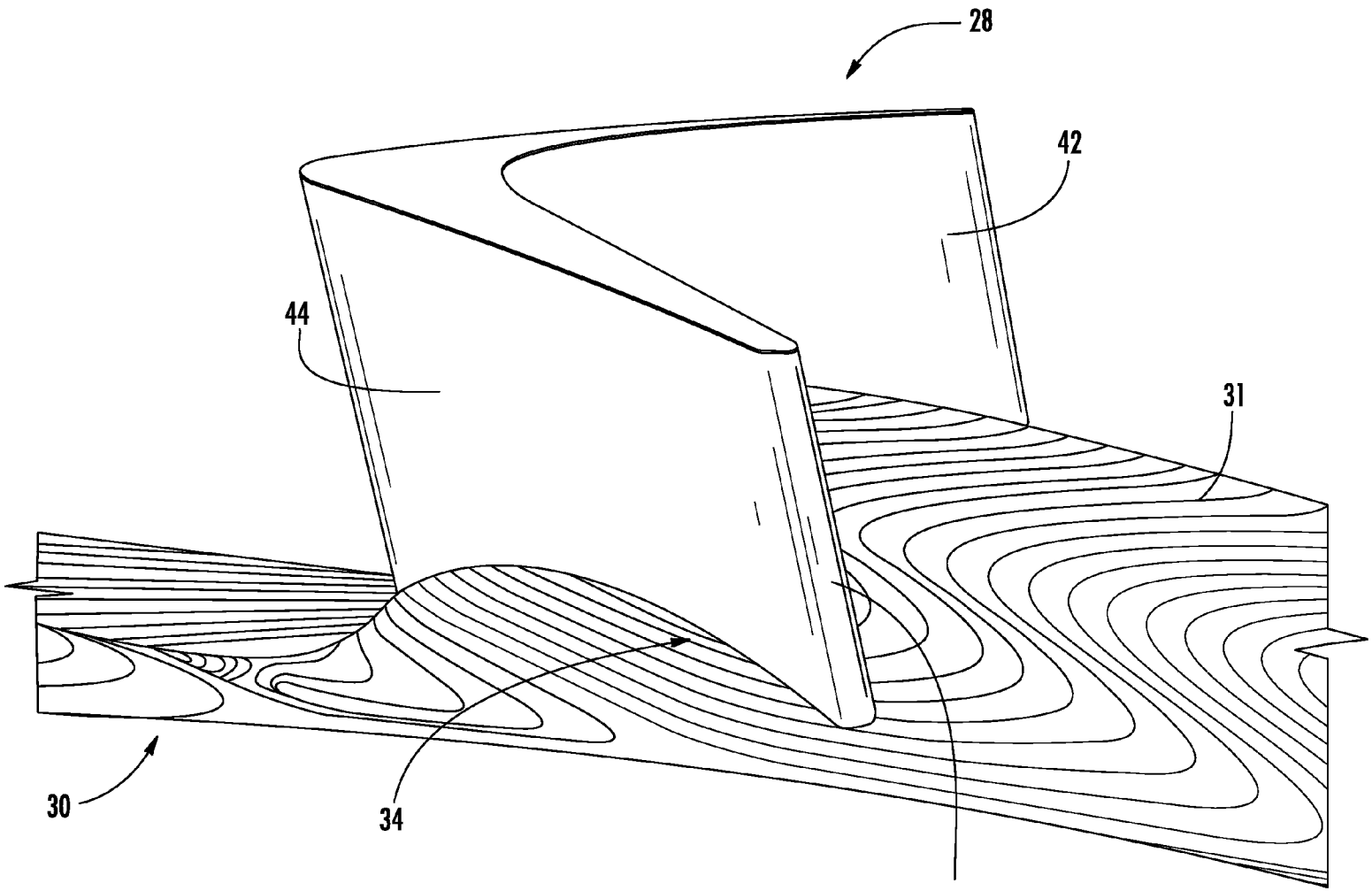
FIG. 10 is a perspective view of a portion of the turbine nozzle of FIG. 4.

As best seen in FIGS. 4 and 8, the trough 48 is present in the hot side 31 of the inner band 30 between each pair of vanes 28, extending generally from the leading edge 38 to the trailing edge 40. The deepest portion of the trough 48 runs along a line substantially parallel to the suction side 44 of the adjacent vane 28, coincident with the line 8-8 marked in FIG. 4. In the particular example illustrated, the deepest portion of the trough 48 is lower than the baseline profile B by approximately 30% to 40% of the total difference in radial height between the lowest and highest locations of the hot side 31, or about three to four units, where the total height difference is about 10 units. In the tangential direction, measuring from the suction side 44 of a first vane 28, the line representing the deepest portion of the trough 48 is positioned about 10% to about 30%, preferably about 20%, of the distance to the pressure side 42 of the adjacent vane 28. In the chordwise direction, the deepest portion of the trough 48 occurs at approximately the location of the maximum section thickness of the vane 28 (commonly referred to as a "high-C" location).

Figure 5:
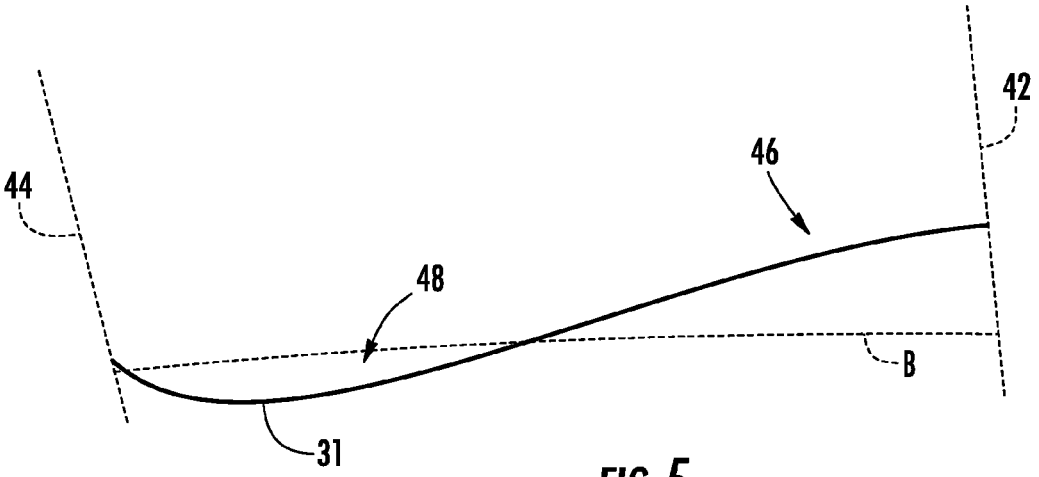
FIG. 5 is a view taken along lines 5-5 of FIG. 4.
Figure 6:
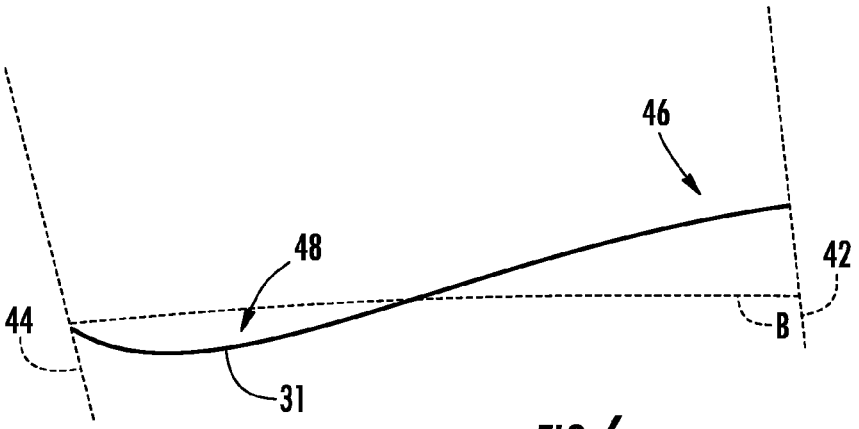
FIG. 6 is a view taken along lines 6-6 of FIG. 4.
Figure 7:
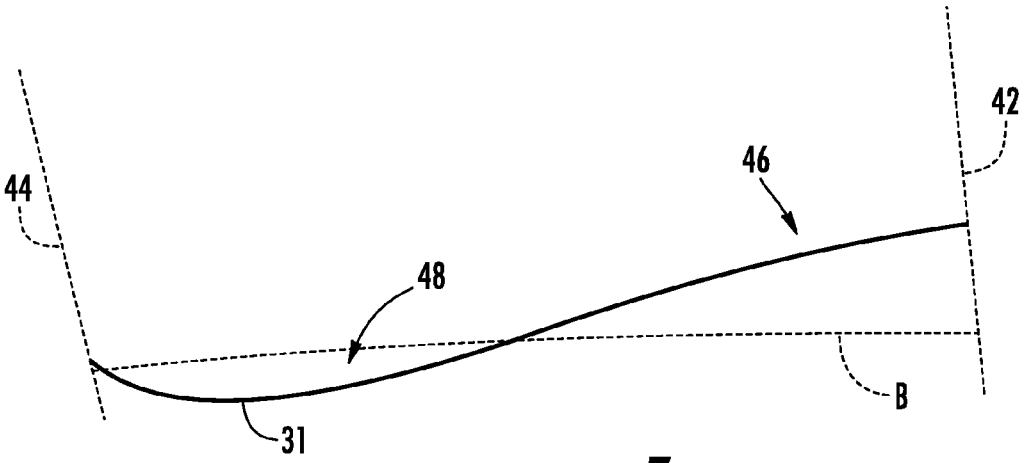
FIG. 7 is a view taken along lines 7-7 of FIG. 4.

As best seen in FIGS. 4-6, the peak 46 is present in the hot side 31 of the inner band 30 between each pair of vanes 28. The peak 46 runs along a line substantially parallel to the pressure side 42 of the adjacent vane 28. A ridge 50 extends from the highest portion of the peak 46 and extends in a generally tangential direction away from the pressure side 42 of the adjacent vane 28. The radial height of the peak 46 slopes away from this ridge 50 towards both the leading edge 38 and the trailing edge 40. The peak 46 increases in elevation behind the leading edge 38 from the baseline elevation B to the maximum elevation greater with a large gradient over the first third of the chord length from the leading edge 38, whereas the peak 46 increases in elevation from the trailing edge 40 over the same magnitude over the remaining two-thirds of the chord length from the trailing edge 40 at a substantially shallower gradient or slope.

In the particular example illustrated, the highest portion of the peak 46 is higher than the baseline profile B by approximately 60% to 70% of the total difference in radial height between the lowest and highest locations of the hot side 31, or about six to seven units, where the total height difference is about 10 units. In the chordwise direction, the highest portion of the peak 46 is located between the mid-chord position and the leading edge 38 of the adjacent vane 28.

In the example shown here, there is no significant ridge, fillet, or other similar structure present on the hot side 31 of the inner band 30 aft of the trailing edge 40 of the vanes 28. In other words, there is a sharply defined intersection present between the trailing edge 40 of the vanes 28 at their roots 34 and the inner band 30. For mechanical strength, it may be necessary to include some type of fillet at this location. For aerodynamic purposes any fillet present should be minimized.

Whereas the peak 46 is locally isolated near its maximum height, the trough 48 has a generally uniform and shallow depth over substantially its entire longitudinal or axial length. Collectively, the elevated peak 46 and depressed trough 48 provide an aerodynamically smooth chute or curved flute that follows the arcuate contour of the flowpath between the concave pressure side 42 of one vane 28 and the convex suction side 44 of the adjacent vane 28 to smoothly channel the combustion gases therethrough. In particular the peak 46 and trough 48 cooperating together conform with the incidence angle of the combustion gases for smoothly banking or turning the combustion gases for reducing the adverse effect of the horseshoe and passage vortices.

Computer analysis of the nozzle and inner band configuration described above predicts significant reduction in aerodynamic pressure losses near the inner band hot side 31 during engine operation. The improved pressure distribution extends from the hot side 31 over a substantial portion of the lower span of the vane 28 to significantly reduce vortex strength and cross-passage pressure gradients that drive the horseshoe vortices toward the airfoil suction sides 44. The 3D contoured hot side 31 also decreases vortex migration toward the mid-span of the vanes 28 while reducing total pressure loss. These benefits increase performance and efficiency of the LPT and engine.

The foregoing has described a turbine nozzle having a 3D-contoured inner band. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A turbine nozzle comprising an array of stationary turbine vanes disposed between an annular inner band and an annular outer band, each of the vanes including a concave pressure side and a laterally opposite convex suction side extending in chord between opposite leading and trailing edges, the vanes arranged so as to define a plurality of flow passages each of which is bounded between the inner band, the outer band, and adjacent first and second vanes;

wherein a surface of the inner band in each of the passages is contoured in a non-axisymmetric shape including a peak of relatively higher radial height adjoining the pressure side of the first vane adjacent its leading edge, and a trough of relatively lower radial height is disposed parallel to and spaced-away from the suction side of the second vane aft of its leading edge, wherein a deepest portion of the trough is spaced-away from the suction side of the second vane;

wherein the peak and trough cooperatively define an arcuate channel extending axially along the inner band between the first and second vanes; and;

wherein the peak is centered at the pressure side of each vane midway between the leading edge and a mid-chord position, and decreases in height forward, aft, and laterally therefrom and the trough is centered at the suction side near the maximum thickness of the vanes, and decreases in depth forward, aft, and laterally therefrom.

2. A turbine nozzle according to claim 1 wherein: the peak decreases in height near the leading edge of the first vane to join the trough along the suction side of the second vane; and the trough extends along the suction side of the second vane to its trailing edge.

3. A turbine nozzle according to claim 1 wherein a line defining the deepest portion of the trough is positioned about 10% to about 30% of the tangential distance from the suction side of the second vane to the pressure side of the first vane.

4. A turbine nozzle according to claim 3 wherein a line defining the deepest portion of the trough is positioned about 20% of the tangential distance from the suction side of the second vane to the pressure side of the first vane.

5. A turbine nozzle according to claim 1 wherein the surface of the inner band aft of the trailing edge of each vane is substantially free of any ridge so as to define a sharp intersection between the trailing edge of each vane at a root thereof and the surface.

* * * * *

UNITED STATES PATENT AND TRADEMARK OFFICE

CERTIFICATE OF CORRECTION

PATENT NO. : 8,727,716 B2
APPLICATION NO. : 12/872485
DATED : May 20, 2014
INVENTOR(S) : Clements et al.

It is certified that error appears in the above-identified patent and that said Letters Patent is hereby corrected as shown below:

On the Title Page, Item (75), under "Inventors", in Column 1, Line 2, delete "Skekhar" and insert -- Shekhar --, therefor.

In the Specification

In Column 3, Line 5, delete "combustor 12" and insert -- combustor 16 --, therefor.

In Column 3, Line 9, delete "compressor 10" and insert -- compressor 14 --, therefor.

In the Claims

In Column 6, Line 20, in Claim 1, delete "and;" and insert -- and, --, therefor.

Signed and Sealed this
Seventh Day of April, 2015

Michelle K. Lee

Michelle K. Lee
*Director of the United States Patent and Trademark Office*